US008234788B2

(12) United States Patent
Rozario et al.

(10) Patent No.: US 8,234,788 B2
(45) Date of Patent: Aug. 7, 2012

(54) METHOD OF MAKING TITANIUM-BASED AUTOMOTIVE ENGINE VALVES

(75) Inventors: Frederick J. Rozario, Fenton, MI (US); Shekhar G. Wakade, Grand Blanc, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1070 days.

(21) Appl. No.: 12/119,746

(22) Filed: May 13, 2008

(65) Prior Publication Data

US 2009/0282675 A1 Nov. 19, 2009

(51) Int. Cl.
*B21D 51/16* (2006.01)

(52) U.S. Cl. ..... 29/890.123; 29/890.12; 123/188.1; 123/188.2; 123/188.3; 123/188.4

(58) Field of Classification Search ..... 29/890.123; 123/188.1, 188.2, 188.3, 188.4
See application file for complete search history.

(56) References Cited

U.S. PATENT DOCUMENTS

| | | | | | |
|---|---|---|---|---|---|
| 3,300,393 | A | * | 1/1967 | Fisher | 203/10 |
| 4,359,022 | A | * | 11/1982 | Nakamura et al. | 123/188.3 |
| 4,606,883 | A | * | 8/1986 | Wizemann et al. | 419/8 |
| 4,834,036 | A | * | 5/1989 | Nishiyama et al. | 123/188.2 |
| 4,852,531 | A | * | 8/1989 | Abkowitz et al. | 123/188.3 |
| 5,094,200 | A | * | 3/1992 | Fontichiaro | 123/188.3 |
| 5,112,415 | A | * | 5/1992 | Mae | 148/421 |
| 5,169,460 | A | * | 12/1992 | Mae | 148/421 |
| 5,405,574 | A | | 4/1995 | Chelluri et al. | |
| 5,441,235 | A | * | 8/1995 | Narasimhan et al. | 251/368 |
| 5,517,956 | A | * | 5/1996 | Jette et al. | 123/188.3 |
| 6,009,843 | A | * | 1/2000 | Griffin et al. | 123/188.3 |
| 6,387,196 | B1 | * | 5/2002 | Yamaguchi et al. | 148/669 |
| 6,869,566 | B1 | * | 3/2005 | Kendig et al. | 419/8 |
| 7,556,011 | B2 | * | 7/2009 | Kishihara et al. | 29/888.4 |
| 7,794,846 | B2 | * | 9/2010 | Itou et al. | 428/469 |
| 2004/0093985 | A1 | | 5/2004 | Carton et al. | |
| 2009/0282675 | A1 | * | 11/2009 | Rozario et al. | 29/888.4 |

FOREIGN PATENT DOCUMENTS

| | | |
|---|---|---|
| DE | 60 2004 002 606 T2 | 8/2007 |
| JP | 5140601 | 6/1993 |

* cited by examiner

*Primary Examiner* — Carl Arbes
(74) *Attorney, Agent, or Firm* — Dinsmore & Shohl LLP

(57) ABSTRACT

An automotive engine valve stem, engine valve and method of producing both. The valve includes a head and a stem joined to the head. Lightweight, high-temperature materials, such as titanium-based materials may be used to make up at least a the majority of the valve. These materials are combined with fabrication techniques that may vary between the head and the stem, where at least a part of the valve is made by dynamic magnetic compaction. While a majority of the stem may be made from a titanium-based powder material, its tip may be made of a high strength hardened material, such as a steel alloy. The valve head may be made by single press and sintering, double press and sintering, forging and machining, forging and sintering, and dynamic magnetic compaction and sintering.

20 Claims, 6 Drawing Sheets

METHOD OF MAKING TITANIUM-BASED AUTOMOTIVE ENGINE VALVES

BACKGROUND OF THE INVENTION

The present invention relates generally to the creation of automotive engine valves using a powder metallurgy process, and more particularly to intake and exhaust valves, where at least portions of each are made by one or more of such processes.

Improved fuel efficiency is an important goal in automotive design. One way to achieve this is through the use of lightweight materials and components. Traditionally, rapidly moving and reciprocating parts, such as engine intake and exhaust valves, have been made from refractory materials, such as steels, superalloys or the like. Such materials, while robust enough to endure the rigors of the internal combustion process, tend to be heavy. This additional weight has an ancillary impact on other components, such as springs, rocker arms, bearings or the like that cooperate with and must therefore be able to withstand the extra forces imposed by the valves.

The introduction of titanium has allowed designers to rely less on refractory materials, providing much of the structural and temperature requirements at a fraction of the weight of steels, superalloys and related refractory materials. Precise additions of alloying ingredients, such as aluminum, vanadium or the like can be used to tailor the structural properties of titanium. For example, the fatigue strength at high temperature for exhaust valve stems must be high, yet not so much so that cold workability and related manufacturing is hampered. Likewise, such agents used in the head portion of an intake valve enhance the strength and hardness; where the tradeoff between wear resistance and component embrittlement must be balanced.

Despite these advantages, titanium has not enjoyed widespread use in engine valve applications. One significant drawback to titanium is that it is expensive to manufacture, especially in light of the differing environmental conditions and requirements at various locations within the valve, such as the valve tip, stem and head. For example, the valve head is subjected to a high temperature environment (up to 1400° Fahrenheit) over significant durations, which could lead to significant creep loading. Likewise, the valve stem temperatures are a little lower (up to 1200° Fahrenheit), but are subjected to significant camshaft and valve spring forces, where compression, tension, shock and fatigue strength properties become important. These concerns are especially relevant to the remote tip region of the valve stem.

Traditionally, engine valves have been made by forging (particularly upset forging) followed by heat treatment and machining, where a titanium alloy rod material is manufactured from an ingot of titanium alloy, that is then molded then hot swaged so as to form a valve shape. Such approaches are labor-intensive, as well as wasteful of the material. Casting techniques have also been used; however, mechanical properties have been less than with forging, and are also not well-suited to using disparate materials within a single casting. More sophisticated casting techniques, such as local chilling or controlled microstructure variation through localized aging can improve the casting, but do so at increased cost, and are often limited to certain (specifically, ferrous-based) materials. With conventional powder metallurgy, a metal alloy powder is compacted to a molded valve shape by cold isostatic pressing, and then sintered. Residual pores in the as-sintered body results in lower ductility and fatigue strength.

Thus, it is desirable that an improved method of making high strength, titanium-based components, such as engine valves, be developed. It is further desirable that different approaches best tailored to particular parts of an engine valve be used to manufacture the valve. It is further desirable that an engine valve made by such method be reliable enough for longer-term use. It is further desirable that a low-cost powder metallurgy manufacturing process that minimizes the likelihood of residual porosity formation be used to make at least portions of such a valve.

BRIEF SUMMARY OF THE INVENTION

These desires are met by the present invention, wherein improved high strength titanium engine valves and methods of making such valves are disclosed. According to a first aspect of the invention, a method of making an automotive engine valves is disclosed. The method includes configuring the valve stem to comprise a first end and a second end opposite the first end such that upon attachment of the valve stem to a valve head, the first end is proximal and the second end is distal relative thereto, the valve stem configured such that at least the first end is made predominantly from a titanium-based powder material, while the second end terminates in a tip made predominantly of a ferrous material with at least one of strength and hardness properties that are adequate to provide necessary wear resistance at the valve tip at an operating temperature of the valve stem. By such construction, this forms a dual material valve stem in a single step using dynamic magnetic compaction (DMC). By this approach, premium materials can be selectively applied to take full advantage of their superior properties while maintaining reasonable manufacturing costs.

Optionally, the method further includes forming a substantially radial lock groove between the first end and the second end of the valve stem. In the present context, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue. In one particular form, a chamfer can be formed at the tip. In another option, a hardening coating can be deposited on the valve stem, with a particular form of the deposition being vapor deposition. The choice of coating can be based on various compatibility and environmental concerns. Given the operating conditions in which an engine valve is expected to operate, coupled with the use of a titanium-based alloy, chromium nitride (CrN) is one suitable coating candidate. Regarding the tip material, a steel alloy is one suitable choice. It can be included in such a way that it is hardened either before or after the valve stem is joined to a valve head. In another option, the ferrous tip can be hardened later on using conventional methods, such as induction heating.

According to another aspect of the invention, a method of forming an automotive engine valve is disclosed. The valve includes a head that is joined to a proximal end of a stem, where a distal end of the stem defines a tip that is hardened relative to the head and remainder of the stem. As with the previous aspect, one significant advantage over current methods of manufacture is that post-forming heat treatment and machining is not required, due to its near net shape and high quality surface finish. The method includes forming a valve stem using DMC, forming a titanium-based valve head and joining the stem to the head.

Optionally, the valve head can be formed from one of various techniques, including single press and sintering, double press and sintering, forge and sintering and DMC and sintering. In another option, the sintering is performed in a controlled atmosphere such that oxygen intake by the compacted material (of the valve head, for example) is below ten parts per million. In yet another optional feature, at least a majority of the valve stem is made from a titanium-based alloy, while the distal tip end may be made from a different material from the titanium alloy used in the remainder of the valve stem. In one form, the different material may be a hardenable steel alloy. This alloy may be hardened either prior to or after the valve stem has been joined to the valve head. The joining of the stem to the head may be achieved by friction welding, diffusion bonding, inertial welding or laser joining under a protective atmosphere to ensure that the joint strength is optimized.

According to yet another aspect of the invention, a titanium-based valve for an internal combustion engine is disclosed. The valve includes a valve head connected to a valve stem, where the valve stem made by DMC as discussed in the previous aspects. As before, the stem includes a first (proximal) end and a second (distal) end opposite the first end. In addition, the valve stem is configured such that at least the first end is made predominantly from a titanium-based powder material.

Optionally, the valve head is made from a different titanium-based alloy than that of the first end of the valve stem. In another option, the tip is made from a hardenable steel alloy. As with the previous aspects, a hardening coating may be disposed on at least a portion of the valve stem. In another option, the valve head may be made from DMC. In addition, the valve head may be joined to the valve stem through DMC.

BRIEF DESCRIPTION OF THE SEVERAL VIEWS OF THE DRAWINGS

The following detailed description of the present invention can be best understood when read in conjunction with the following drawings, where like structure is indicated with like reference numerals and in which.

DETAILED DESCRIPTION OF THE PREFERRED EMBODIMENTS

Figure 1:
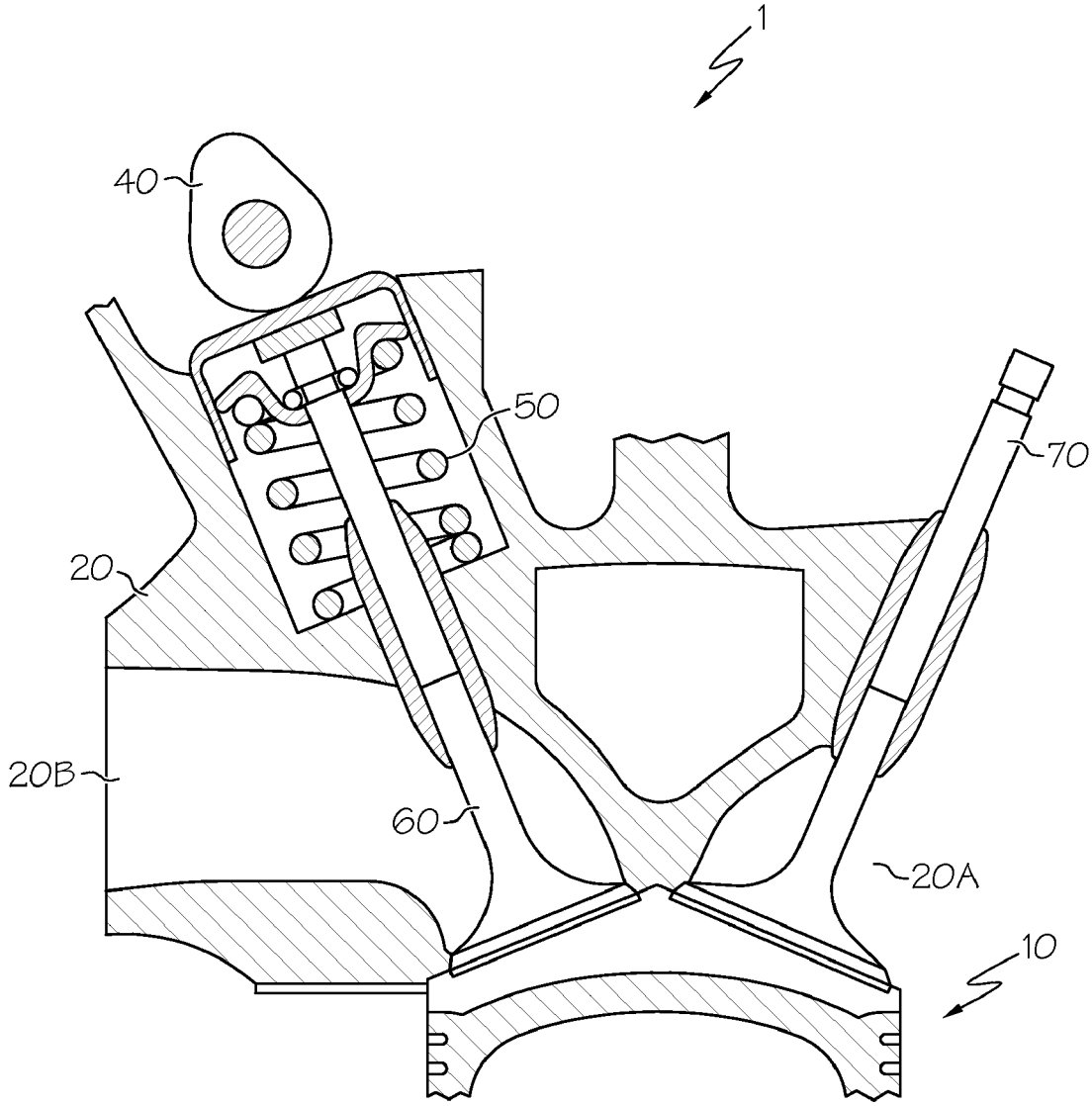
FIG. 1 shows a cutaway view of an automotive cylinder head with intake and exhaust valves.

Referring initially to FIG. 1, portions of the top of an automotive engine is shown. Piston 10 reciprocates within a cylinder in the engine block. A cylinder head 20 includes intake ports 20B and exhaust ports 20A to convey the incoming air and spent combustion byproducts, respectively that are produced by a combustion process taking place between the piston 10 and a spark plug (not shown) in the cylinder. A cam 40 (which is driven from an external source, such as a crankshaft (not shown)), upon rotation about its longitudinal axis, selectively overcomes a bias in spring 50 to force intake valve 60 and exhaust valve 70 to force open the intake ports 20B and exhaust ports 20A at the appropriate time. It will be appreciated that the cam 40 and spring 50 shown in cooperation with intake valve 60 is also used on exhaust valve 70, but have been removed from the present figure for clarity.

Figure 2A:
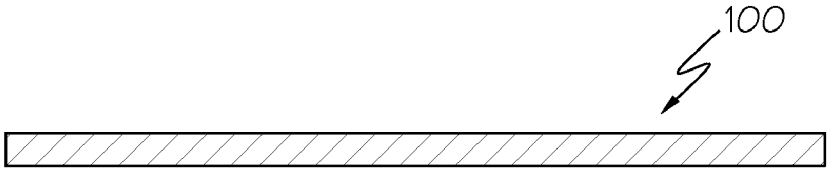
FIGS. 2A through 2E show the various steps associated with making a titanium valve using forging and machining according to the prior art.
Figure 2B:
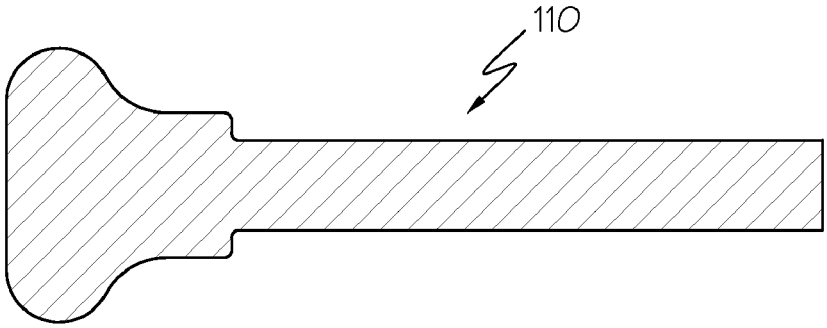
Figure 2C:
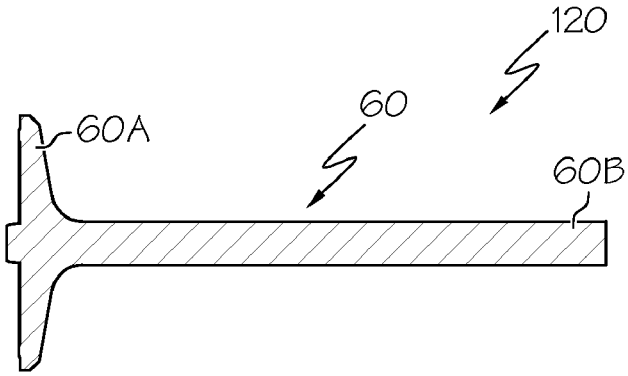
Figure 2D:
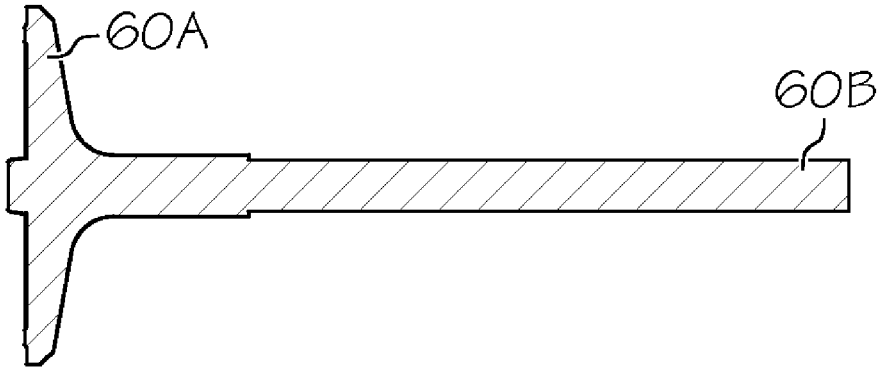
Figure 2E:
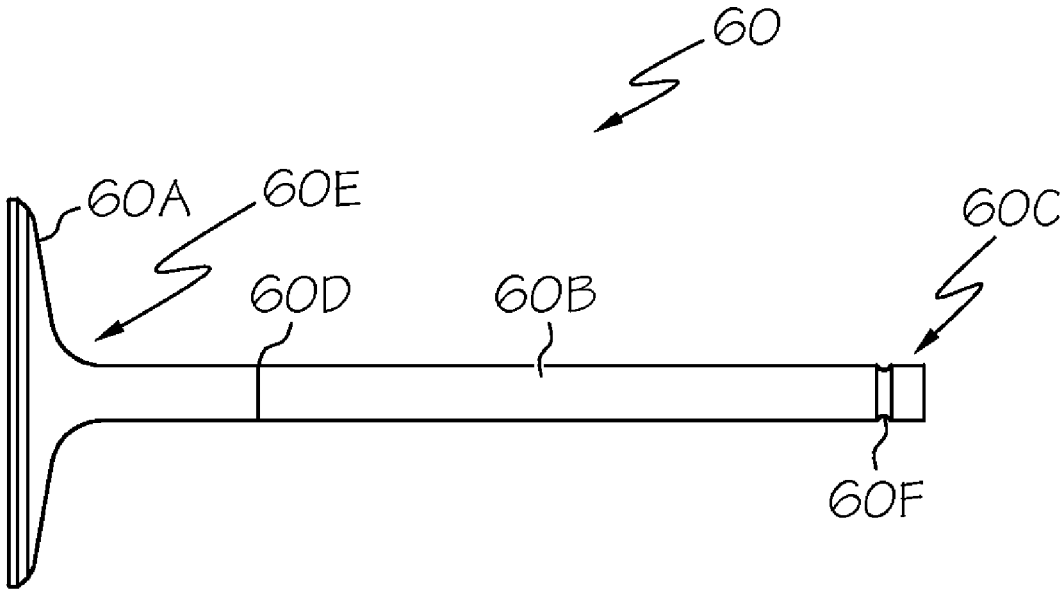

Referring next to FIGS. 2A through 2E, a conventional method of manufacturing an engine valve according to the prior art is shown. The titanium bar 100 of FIG. 2A is machined to produce a bloom 110, as shown in FIG. 2B. The forging step of FIG. 2C results in the formation of a separate head 60A and stem 60B such that the general shape of intake valve 60 starts to appear, while the raw machining step of FIG. 2D further refines the shape. Finally, FIG. 2E shows a finished intake valve 60, including head 60A, stem 60B with tip 60C, joined interface region 60D and radiused fillet 60E. A radial lock groove 60F is formed between the tip 60C and the stem 60B, which provides a retaining feature between the valve stem and a valve spring cap. The subject feature may be formed from either ferrous or titanium material. When the double press approach is used, the formed part hardness after the first cycle should not be so high that significant densification in the second molding cycle is precluded. Although not shown, one or more heat treatments may be performed during the steps shown in FIGS. 2A through 2E.

Figure 3A:
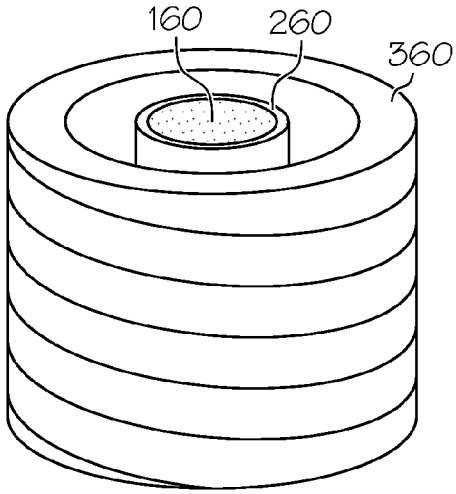
FIGS. 3A through 3C show the steps used to make a titanium valve stem using a DMC process.
Figure 3B:
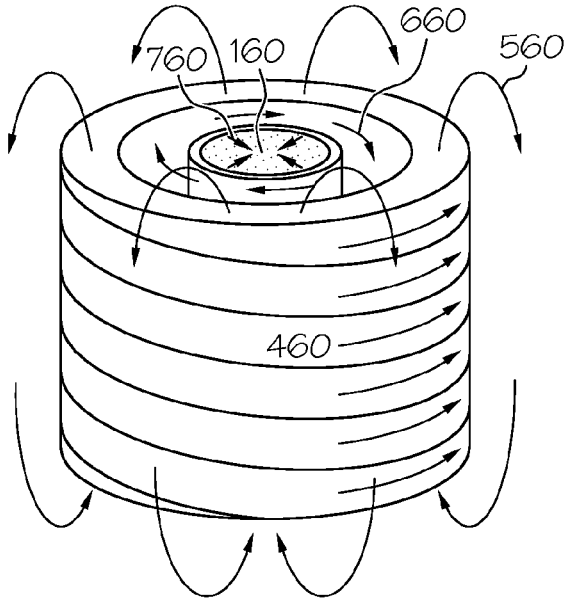

Referring next to FIGS. 3A through 3C and 4, a method of manufacturing the valve 60 includes forming the valve head 60A separately from the valve stem 60B and tip 60C. Referring with particularity to FIG. 3B, DMC takes advantage of the compressive force of a magnetic field on a powder precursor placed in that field. Upon imposition of an electric current 460 on coil 360, a magnetic flux 560 is set up in a normal direction as shown. This in turn sets up magnetic pressure pulse 660 that acts to impart a radially inward pressure 760 on the precursor powder 160. In it, the precursor powder 160 is consolidated into a full density parts in a very brief amount of time (for example, less than one second). Referring with additional particularity to FIGS. 3A and 3C, in the DMC process, the powder 160 is placed in an appropriate vessel (called an armature or sleeve 260). The powder 160 is compacted from its initial size in FIG. 3A to form the diametrically smaller cylindrical stem 60B portion shown in FIG. 3C. Initially, the cylindrical cavity inside the coil is filled with an appropriate amount of titanium alloy powder mix, followed by a steel alloy powder of desired composition on the top. This magnetic pressure pulse consolidates the composite powder mix at relatively low temperatures almost instantaneously. In addition, this operation can (if necessary) be performed in a controlled environment to avoid contaminating the consolidated material. The uniform pressure distribution is ideal for forming components made from uniform-shaped parts, of which an axisymmetric valve stem (such as valve stem 60B) is but one example.

Preparation of the stem 60B may include using two different materials (one for the majority of the stem 60B and another for the tip 60C) and employing a one step DMC process. In one exemplary form, the stem 60B can be made from a titanium powder alloy and the tip 60C is made from a hardened steel alloy. The titanium powder may include various additives tailored to the end use. In one example, the titanium alloy may be Ti 6-2-4-2, which includes about six percent aluminum (Al), two percent tin (Sn), four percent vanadium (V) and two percent molybdenum (Mo). Further, grain refining agents (such as boron-containing compounds) can be included in the powder mix, if deemed desirable.

In addition to the DMC process which includes the use of inserts to provide profile, it will be appreciated that other approaches to forming the valve head 60A may be used, such single or double press and sintering, forging and sintering, or DMC plus sintering. The sintering operation can be carried out in a controlled atmosphere, in this way oxygen and related contamination intake by the titanium-based powder is kept to a permissible level (such as below 10 ppm). Solution and aging treatments (for example, age hardening) can be employed to further improve the mechanical properties. To even further improve the properties (for example, wear) of the valve 60, ceramic-based coatings (for example, CrN) can be applied to select valve 60 portions. Such coatings can be deposited by methods, such as physical vapor deposition (PVD) known to those skilled in the art. In one particular form, the coating can be applied to the valve stem 60B and face of valve head 60A.

Once each of the head 60A and stem 60B (plus tip 60C) have been prepared, they can be joined at interface region 60D by one of various methods. In a first, friction welding in controlled atmosphere is used. In a second, laser welding and cladding (also in controlled atmosphere) can be used. In a third approach, a threaded joint with interference secures the two, while in a fourth, an interference fit without threads is used. Also in one embodiment the two sections of the valve, namely head 60A and stem 60B may be sintered separately and then joined, or sintered after joining.

Figure 4:
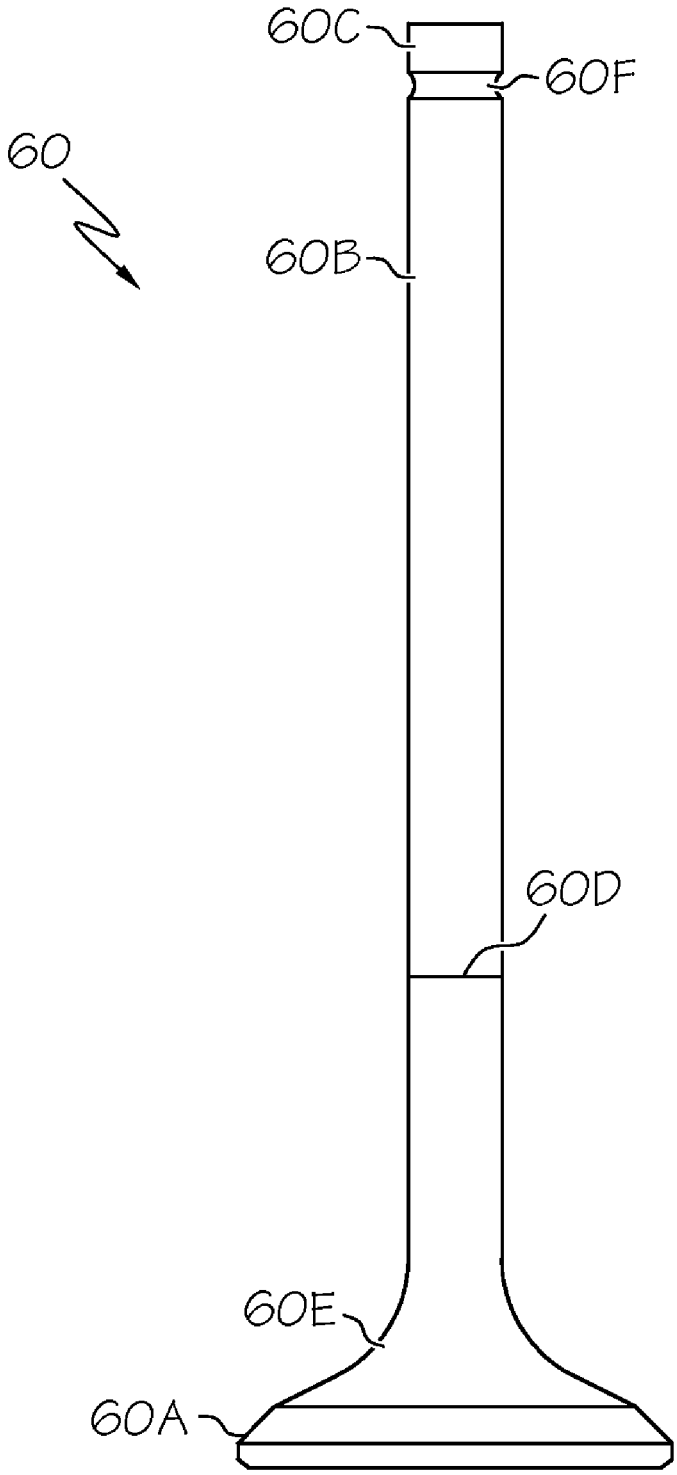
FIG. 4 shows an engine valve made according to the present invention.

Referring next to FIG. 4, the valve 60 of FIG. 2E is shown in more detail, particularly in the head 60A. In a preferred form, head 60A is made by one or more powder metallurgy techniques, such press and sinter, powder forge and sinter or double press and sinter. Detailed features in the head 60A, such as those associated with the face, underhead radius, head outer diameter chamfer, cup or the like, may make it difficult to achieve adequate mechanical properties through a conventional single press and sinter operation. In such cases, a double press and sinter approach may be used as it would improve the overall density and hence the mechanical properties of the head 60A, over single press and sinter parts. In addition, a controlled atmosphere may be used to minimize oxygen intake during the sintering operation.

Depending on the load and environmental requirements, the head 60A and stem 60B can made from the same or different titanium-based powders. Likewise, different powder metallurgical techniques may be used. The valve stem 60B, by virtue of its axisymmetric shape, is amenable to formation through the DMC process. For example, the stem 60B can be made by the DMC process such that the tip 60C is made using hardenable steel alloy. In one form, this can be achieved in one step. The valve stem 60B is preferably made from titanium alloy powder whereas the tip 60C of the stem 60B is made by using the steel powder which could be hardened later on. The valve head 60A and the stem 60B could be made from the same titanium-based alloy or could be made from different alloys. The benefits of using low cost titanium powders, powder metallurgical technique and near net shape would reduce the component cost over the forged titanium valves made from wrought alloys.

Figure 5A:
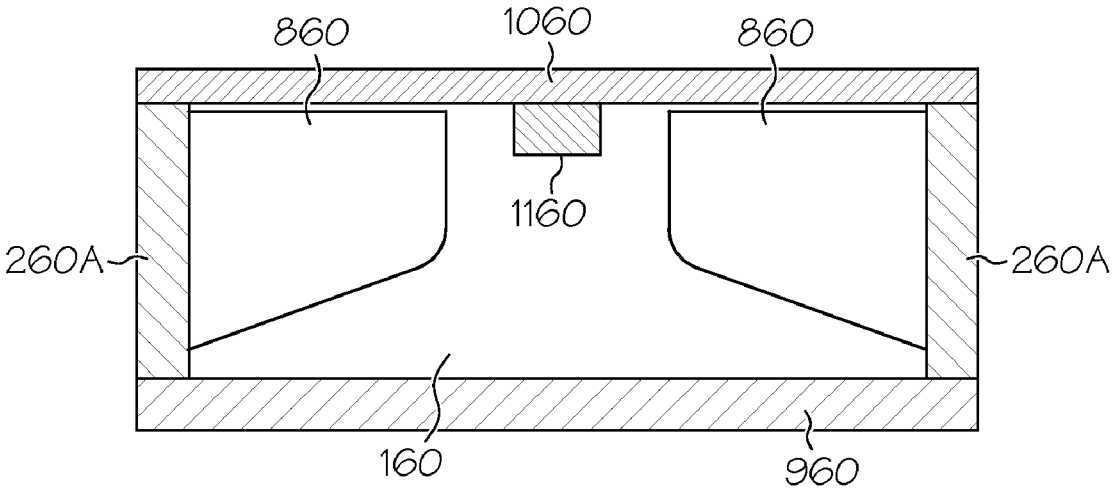
FIG. 5A shows using DMC to form a valve head.
Figure 5B:
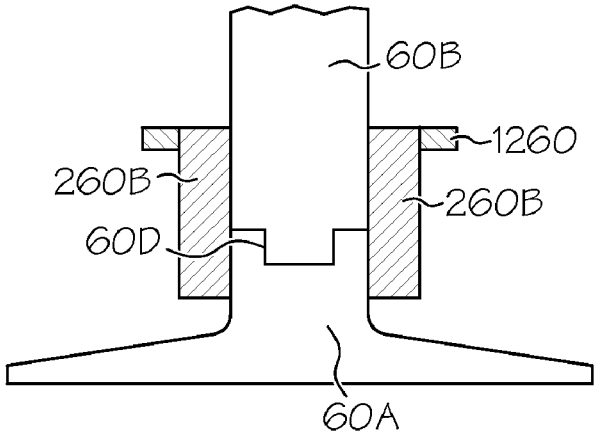
FIG. 5B shows using DMC to join a valve stem to a valve head.

The valve head 60A can be joined to the stem 60B by friction welding or any mechanical interlocking method or by laser joining method. Likewise, the sections may also be joined by DMC processing. Moreover, each of these parts of valve 60 may be made from DMC processing. Referring next to FIGS. 5A and 5B, the DMC process may be used in different ways in general, and in at least two different particular ways as it relates to manufacturing valve head 60A and valve stem 60B. With regard to the former, parts can be formed from powder metal using DMC magnetic compaction, while in the latter to join parts using DMC compressive deformation to produce interference fits.

Figure 3C:
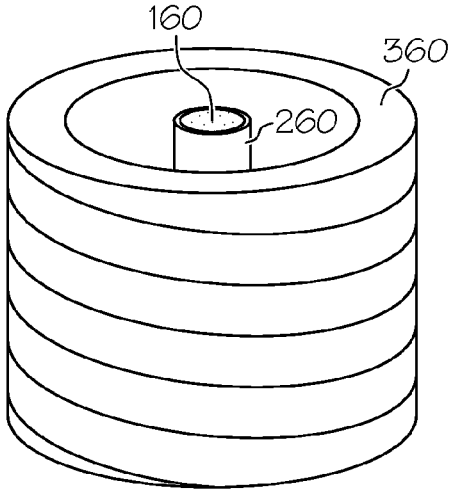

Referring with particularity to FIG. 5A, inserts 860 are placed within a sacrificial copper sleeve 260A that is used to define a generally axisymmetric mold in the shape of the head 60A and radiused fillet 60E. Sleeve 260A is deformed by an imposed magnetic field (generally similar to those shown and described in conjunction with FIGS. 3A through 3C) to create the compressive forces for powder compaction, which results in formation of a "green" or un-sintered valve head 60A, after which conventional sintering, machining and related finishing steps may be employed. The radiused fillet 60E formed may or may not need further machining depending upon the design specifics, and may, in another form (not shown) be formed as an angled corner instead of the fillet. The plates include a lower plate 960 and upper plate 1060 that includes a center core rod 1160. The sidewalls are made up of coil 360 as shown in FIGS. 3A through 3C. The precursor powder 160 is placed within the voids left between the plates 960, 1060, center core rod 1160 and inserts 860 and processed in a manner generally similar to that discussed in conjunction with FIGS. 3A through 3C and 4.

Referring with particularity to FIG. 5B, once the head 60A and the stem 60B are formed separately using the DMC process for magnetic compaction, a second DMC operation can be used to join the two through an interference fit can be employed. As shown, two previously formed "green" parts (i.e., the valve stem 60B and valve head 60A) could be joined using the DMC process, where a sleeve 260B is placed concentrically around the interface region 60D. Flange 1260 can be used to remove the sleeve 260B once the compaction process has been completed. As can be seen from a comparison of the sleeves 260A and 260B in their respective figures, both the starting dimensions and the shapes are different. Specifically, sleeve 260B would be smaller, and would also include the aforementioned flange 1260. In other regards, the two sleeves 260A and 260B are generally similar in that they both function as sacrificial (i.e., deformable) carriers of electric current that is used to effect the DMC process.

As discussed above, once the head 60A and stem 60B have been joined, additional processing (such as minimal machining) can be done. Moreover, protective coatings, for example, CrN, can be applied. In another form, the head 60A can be made from a conventional process, such as forging. Such an operation does not preclude the use of the DMC process to join the head 60A to the stem 60B. In friction welding as well as in case of laser joining, the interface between the head 60A and the stem 60B may essentially be flat without the special features center core rod 1160 and interface region 60D.

While certain representative embodiments and details have been shown for purposes of illustrating the invention, it will be apparent to those skilled in the art that various changes may be made without departing from the scope of the invention, which is defined in the appended claims.

What is claimed is:

1. A method of fabricating an automotive engine valve stem, said method comprising:

configuring said valve stem to comprise a first end and a second end opposite said first end such that upon attachment of said valve stem to a valve head, said first end is proximal and said second end is distal relative thereto, said valve stem configured such that at least said first end is made predominantly from a titanium-based powder material, while said second end terminates in a tip made predominantly of a material with at least one of strength and hardness properties that are at least as great as that of said titanium-based material at an operating temperature of said valve stem; and forming said valve stem using dynamic magnetic compaction.

2. The method of claim 1, further comprising forming a substantially radial lock groove between said first end and said second end of said valve stem.

3. The method of claim 1, further comprising forming a chamfer at said tip.

4. The method of claim 1, further comprising depositing a hardening coating on at least a portion of said valve stem.

5. The method of claim 4, wherein said depositing a hardening coating on said valve stem comprises using vapor deposition.

6. The method of claim 5, wherein said hardening coating comprises chromium nitride.

7. The method of claim 1, wherein said material with at least one of strength and hardness properties that are at least as great as that of said titanium-based material at an operating temperature of said valve stem comprises a steel alloy.

8. A method of fabricating an automotive engine valve, said method comprising:

forming a valve stem using dynamic magnetic compaction, said valve stem comprising a proximal interface end and a distal end, said distal end defining a tip;

forming a titanium-based valve head; and joining said valve stem to said head.

9. The method of claim 8, wherein said forming said valve head is selected from the group consisting of single press and sintering, double press and sintering, forge and sintering and dynamic magnetic compaction and sintering.

10. The method of claim 8, wherein said sintering is performed in a controlled atmosphere such that oxygen intake by said valve head is below 10 parts per million.

11. The method of claim 8, wherein at least a majority of said valve stem comprises a titanium-based alloy.

12. The method of claim 11, further comprising forming said distal tip end from a different material from said titanium alloy used in said at least a majority of said valve stem.

13. The method of claim 12, wherein said different material comprises a hardenable steel alloy.

14. The method of claim 13, wherein said hardenable steel alloy is hardened after said valve stem has been joined to said valve head.

15. The method of claim 8, wherein said joining comprises at least one of friction welding, diffusion bonding, inertial welding, laser joining and dynamic magnetic compaction.

16. A titanium-based valve for an internal combustion engine, said valve comprising:

a valve head; and a valve stem connected to said valve head, said valve stem made by dynamic magnetic compaction and comprising a first end and a second end opposite said first end such that said first end is proximal and said second end is distal relative to said valve head, said valve stem configured such that at least said first end is made predominantly from a titanium-based powder material, while said second end terminates in a tip made predominantly of a material with at least one of strength and hardness properties that are at least as great as that of said titanium-based material at an operating temperature of said valve stem.

17. The valve of claim 16, wherein said valve head is made from a different titanium-based alloy than said first end of said valve stem.

18. The valve of claim 16, wherein said tip comprises a hardenable steel alloy.

19. The valve of claim 16, further comprising a hardening coating disposed on at least a portion of said valve stem.

20. The valve of claim 16, wherein said valve head is made by dynamic magnetic compaction and said connection between said stem and said head is through dynamic magnetic compaction.

* * * * *